US007040422B2

(12) United States Patent
Springer

(10) Patent No.: US 7,040,422 B2
(45) Date of Patent: May 9, 2006

(54) DRILL STRING MEMBER

(76) Inventor: Johann Springer, Daupuinestr, 22, Linz, A-4030 (AT)

( * ) Notice: Subject to any disclaimer, the term of this patent is extended or adjusted under 35 U.S.C. 154(b) by 186 days.

(21) Appl. No.: 10/398,979

(22) PCT Filed: Oct. 9, 2001

(86) PCT No.: PCT/IB01/02105

§ 371 (c)(1),
(2), (4) Date: Apr. 10, 2003

(87) PCT Pub. No.: WO02/31312

PCT Pub. Date: Apr. 18, 2002

(65) Prior Publication Data

US 2004/0003945 A1 Jan. 8, 2004

(30) Foreign Application Priority Data

Oct. 11, 2000 (GB) ..... 0024909

(51) Int. Cl.
*E21B 17/22* (2006.01)

(52) U.S. Cl. ..... 175/323; 138/122; 166/242.1; 175/320

(58) Field of Classification Search ..... 175/323, 175/320, 393, 394; 138/122, 118, DIG. 11; 166/242.1
See application file for complete search history.

(56) References Cited

U.S. PATENT DOCUMENTS 2,108,195 A * 2/1938 Crow ..... 175/320
2,246,418 A * 6/1941 Ward et al. ..... 175/323

(Continued)

FOREIGN PATENT DOCUMENTS

GB 1345924 2/1974

(Continued)

OTHER PUBLICATIONS

SPE 22549 Differential Sticking Laboratory Tests Can Improve MUD Design by M. Bushnell-Waston & S.S. Panesar, 66th Annual Conference and Exhibition of the Society of Petroleum Engineers, Dallas, Texas, Oct. 6-9, 1991.

(Continued)

*Primary Examiner*—Kenneth Thompson
(74) *Attorney, Agent, or Firm*—Timothy J. Keefer; Seyfarth Shaw LLP

(57) ABSTRACT

A drill string member is formed by providing a former and a cylindrical member to be shaped in relationship with the former. Seals are provided between opposing ends of a thick wall cylinder and the cylindrical member, a pressure is applied in the annulus between the cylindrical member and the thick wall cylinder sufficient to deform the cylindrical member against the former. The drill string member thus formed has a constant wall thickness and a non-circular former provides a non-circular drill string member.

12 Claims, 4 Drawing Sheets

U.S. PATENT DOCUMENTS

| | | | | |
|---|---|---|---|---|
| 2,685,462 | A | | 8/1954 | Lofqvist |
| 3,085,639 | A | * | 4/1963 | Fitch ..... 175/323 |
| 3,146,611 | A | * | 9/1964 | Fox ..... 464/183 |
| 3,889,506 | A | | 6/1975 | Shaffer |
| 4,043,611 | A | * | 8/1977 | Wallace ..... 175/325.1 |
| 4,751,836 | A | | 6/1988 | Breese |
| 4,771,811 | A | | 9/1988 | DeCell et al. |
| 4,811,800 | A | * | 3/1989 | Hill et al. ..... 175/323 |
| 4,951,493 | A | | 8/1990 | Fragge et al. |
| 5,040,620 | A | | 8/1991 | Nunley |
| 5,150,757 | A | | 9/1992 | Nunley |
| 5,203,190 | A | | 4/1993 | Kramer et al. |
| 5,388,655 | A | | 2/1995 | Gruber |
| 6,012,744 | A | | 1/2000 | Wilson et al. |

FOREIGN PATENT DOCUMENTS

| | | |
|---|---|---|
| RU | 2042777 | 8/1995 |

OTHER PUBLICATIONS

SPE 14244 A New Approach to Differential Sticking by J.M. Courteille & C. Zurdo, 60th Annual Technical Conference and Exhibition of the Society of Petroleum Engineers, Las Vegas, Nevada, Sep. 22-25, 1985.

* cited by examiner

DRILL STRING MEMBER

CROSS REFERENCE TO RELATED APPLICATION

This application claims the priority of Great Britain patent application Ser. No. 0024909.4, filed on Oct. 11, 2000.

BACKGROUND OF THE INVENTION

1) Field of the Invention

This invention relates to a drill string member and particularly to a drill string member arranged to alleviate or prevent differential sticking downhole.

2) Description of the Related Art

It is known from the Society of Petroleum Engineers, Paper SPE22549, "Differential Sticking Laboratory Tests can improve Mud Design" by M. Bushnell-Watson and S. S. Panesar, presented to the $66^{th}$ Annual Conference and Exhibition of the Society of Petroleum Engineers held in Dallas, Tex., Oct. 6–9, 1991, that differential sticking occurs when a drill pipe, or logging tool, becomes embedded in mud filter cake and where the drill pipe or filter tool is held by the mud overbalance pressure. Once sticking has occurred, a large force is required to free the drill pipe, even if the mud overbalance is removed. Such sticking causes several hours of rig time being spent in attempting to free the drill pipe. In severe cases, the drill pipe cannot be freed and the well has to be sidetracked or abandoned. In the disclosure, a laboratory method is disclosed for freeing differentially stuck pipes with sheer and changes are proposed to the mud chemistry. As disclosed in the Society of Petroleum Engineers, Paper SPE14244, "A New Approach to Differential Sticking" by J. M. Courteille and C. Zurdo, presented at the $60_{th}$ Annual Technical Conference and Exhibition of the Society of Petroleum Engineers held in Las Vegas, Nev., Sep. 22–25, 1985, differential sticking has a high risk of occurrence in deviated wells and the paper describes recording the pressure at different points of the pipe/cake and cake/formation interfaces in a laboratory device. It is also known from, for example, U.S. Pat. No. 4,811,800 to produce a flexible drill string member for use in directional drilling in which the member has a spirally-shaped outer surface so as to make the member more flexible at traversing bends in boreholes. Such a member is formed from a steel tube which has the outer surface thereof machined to form a spiral. The wall thickness, therefore, varies.

U.S. Pat. No. 6,012,744 discloses a heavy weight drill pipe which also incorporates tubular members having spirally formed external surfaces and the spirally formed members are taught to reduce the chances of differential pressure sticking of the pipe when the pipe is used in a high angle or horizontal well bore.

Forces involved in the occurrence of differential sticking are substantially proportional to the area of a drill string element embedded in the filter cake. It will be understood by those skilled in the art that the filter cake is formed on the borehole wall when drilling through permeable formations. A reduction in the area of contact between the filter cake and the drill string element is thus a major objective of the spirally formed external surface of the member disclosed in U.S. Pat. No. 6,012,744.

By using a spiral formation with a right hand thread, in high angle holes, cuttings may be lifted into the main stream of the flowing mud and such right hand spiral designs increase the load effective at the bit by "screwing" the string towards the bit end while cuttings that have not been lifted into the main stream mud are pushed upwards along the low side of the hole in the manner of an Archimedian screw pump.

Such spirally formed members of the prior art have internal cross-sections which are cylindrical and with an outer surface of varying diameters which vary along the drill string longitudinal axis. The manufacturing process of drill string members such as drill pipes, intermediate weight drill string elements and heavyweight drill pipe elements, as well as drill collars having a non-circular cross-section for at least a part of their axial length, requires costly and time-consuming external removal of metal by milling. In addition, eventual drilling a long cylindrical bore may also be required when using an initially solid bar stock to produce the above-mentioned devices.

SUMMARY OF THE INVENTION

The present invention seeks to provide a drill string member having an external surface of varying diameters which is more readily produced.

According to one aspect of this invention, there is provided a method of forming a drill string member including the steps of providing a former, providing a cylindrical member to be shaped in relationship with the former, providing sealing means at opposing ends of the cylindrical member and the former, and applying a pressure sufficient to plastically deform said cylindrical member against said former, whereby a substantially constant wall thickness about the circumference of the cylindrical member is provided.

According to a feature of this invention, there is provided a method of forming a drill string member including the steps of providing an external cylinder, inserting a core in a cylindrical tubular member, said core having a desired shaped external surface for the walls of said tubular member, locating the cylindrical tubular member and core in the external cylinder, sealing the tubular member at its remote ends, applying a pressure to an annulus formed between the cylinder and the tubular member sufficient to plastically deform the tubular member against the externally shaped surface of the core, whereby the walls of the tubular member have a substantially constant thickness about the periphery of the tubular member, and removing the seals and core.

According to another feature of this invention, there is provided a method of forming a drill string member including the steps of providing a former having an internal surface corresponding to a shape to be formed, providing a cylindrical tubular member to be shaped inside said former, providing sealing means at opposing ends of the tubular member, applying a pressure to the inside of said tubular member sufficient to plastically deform said tubular member against the internal surface of said former, whereby said deformed tubular member has a substantially constant wall thickness about the circumference thereof.

Preferably, portions having a circular cross-section are located at opposing ends of the plastically deformed tubular member.

Preferably, the pressure applied is produced by one of hydro-forming and explosive-forming.

Advantageously, after plastically deforming said tubular member it is heat treated to relieve stresses.

According to another aspect of this invention there is provided a drill string member arranged to at least alleviate differential sticking and/or to facilitate the transport of cuttings in at least one of a high angle and a horizontal well bore including at least one tubular member having a portion with a non-circular internal and external cross-section, whereby a substantially constant wall thickness about the circumference thereof is provided.

Preferably, opposing end portions of said non-circular portion are provided having a substantially circular cross-section.

Advantageously, said non-circular portion has an undulating outer surface with crests and troughs extending across a longitudinal axis of said member.

In a preferred embodiment, said crests and troughs form a spiral groove in a wall of said member.

Preferably, said spiral groove is a right hand spiral.

Alternatively, said crests and troughs extend along a longitudinal axis of said member.

Advantageously, tool joints are secured by, for example, friction welding to said circular end portions.

Advantageously, said member has two or more crests, advantageously three to eight crests and, preferably, six crests are provided in a plane transverse to a longitudinal axis through said non-circular portion.

Advantageously, plural said tubular members are provided in a drill string, each interconnected by an interconnecting member having a substantially constant external diameter.

According to yet a further feature of this invention, said drill string member is used as one of a drill pipe, an intermediate weight drill pipe, a heavyweight drill pipe, a drill collar, and a wash-over pipe.

According to a further aspect of this invention there is provided a drill string member made as defined herein above and used to at least alleviate differential sticking, said member being in accordance with said another aspect.

The drill string member of the present invention improves the transport of cuttings from downhole in at least one of a high angle and a horizontal well bore, especially when formed in a spiral configuration.

BRIEF DESCRIPTION OF THE DRAWINGS

The invention will now be described, by way of example, with reference to the accompanying drawings in which.

In the FIGS. like reference numerals denote like parts.

DESCRIPTION OF THE PREFERRED EMBODIMENT

Figure 1:
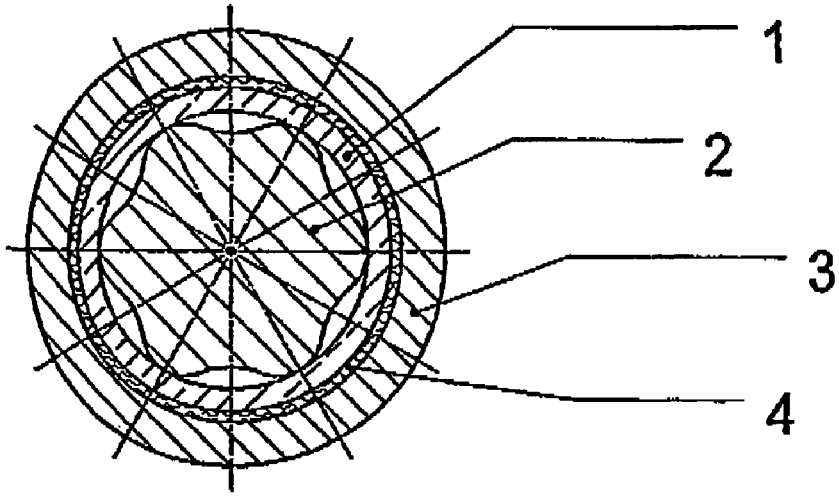
FIG. 1 shows a transverse cross-section through an apparatus for forming a drill string member in accordance with this invention in a first step of formation.
Figure 2:
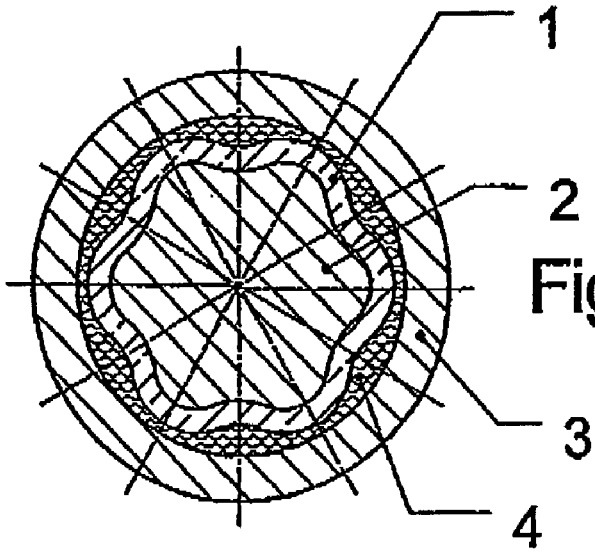
FIG. 2 shows a further step in forming the drill string member in accordance with this invention.
Figure 3:
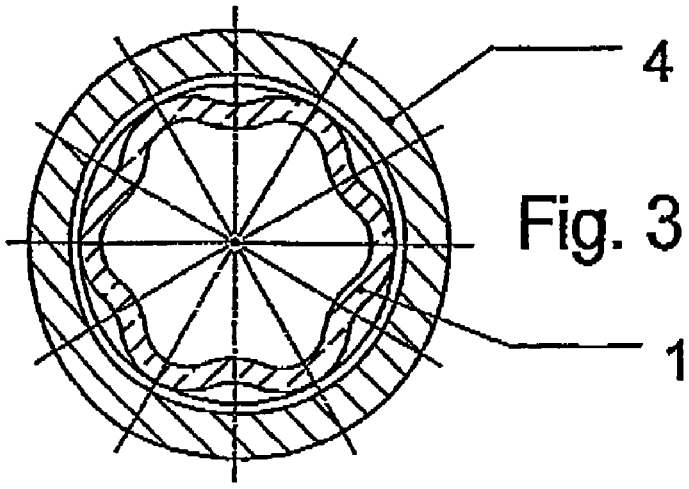
FIG. 3 shows another step in the formation of the drill string member in accordance with this invention.

FIGS. 1, 2 and 3 show stages in forming a drill string member in accordance with a first embodiment of this invention.

Figure 10:
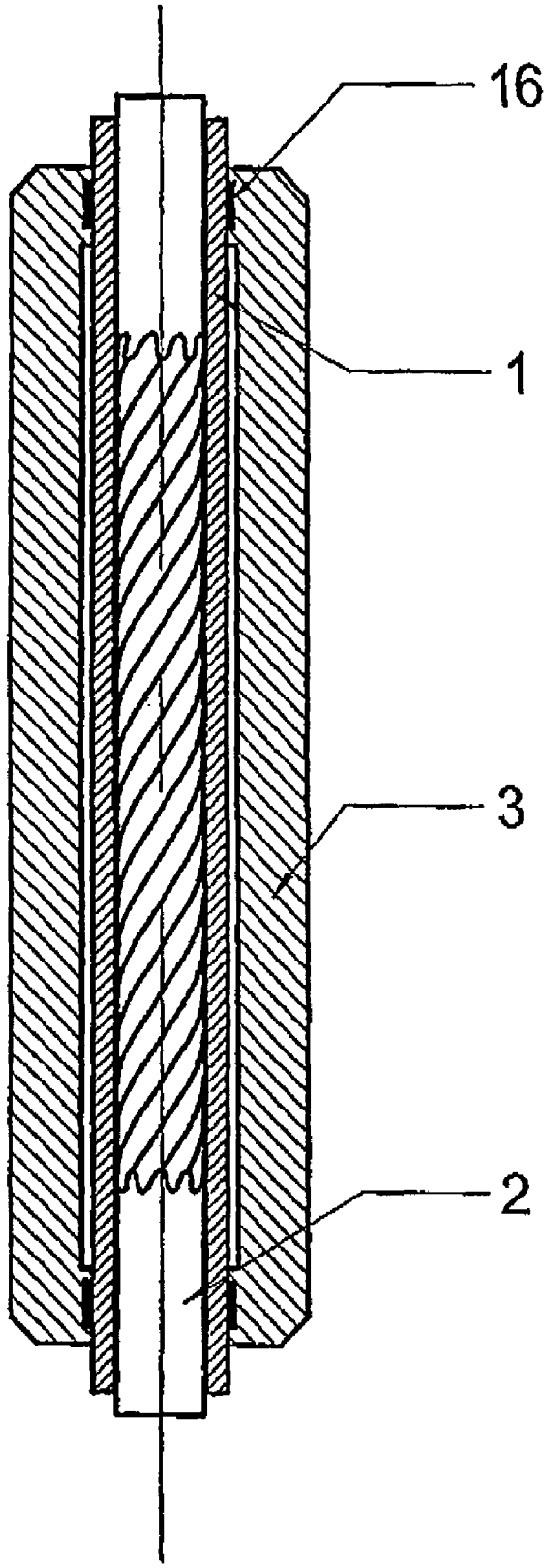
FIG. 10 shows a longitudinal cross-section of the assembly shown in FIG. 4.

FIG. 1 shows a cylindrical tubular member to be deformed and an axially split core 2 is inserted into the member 1, the core being a former having a desired external shape to which the member 1 is to be formed. The core 2 has a forming portion of the desired configuration with circularly cross-sectioned opposing end portions, the outside diameters of which correspond substantially with the internal diameter of member 1. The forming portion of the core may have peaks and troughs extending substantially Parallel to the longitudinal axis of the core/tubular member or, preferably, the peaks and troughs extend along and across a longitudinal axis of the core/tubular member in a spiral formation, advantageously a right hand spiral. The core 2 is arranged to fit inside the inside diameter of the member 1, but is arranged that a forming non-cylindrical section does not extend over the extreme ends of the member 1 so that the extreme ends remain unformed. The member 1 and core 2 are inserted into a pressure chamber formed by a thick walled cylinder 3 and seals 16 (shown in FIG. 10). Fluid, preferably liquid, is inserted into the annulus between the member 1 and cylinder 3 and high pressure is applied so as to deform the member 1 inwardly to take the shape of the external surface of the core 2 (as shown in FIG. 2).

Figure 4:
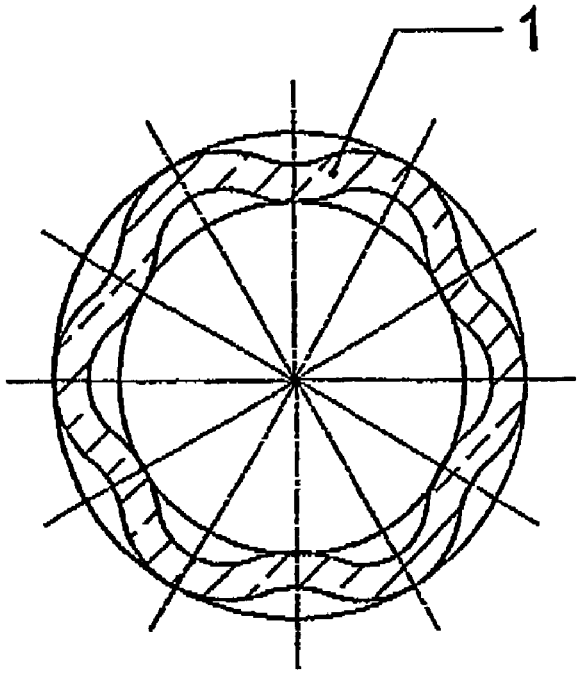
FIG. 4 shows a cross-sectional view of a drill string member formed in accordance with this invention.

The seals and fluid are removed to provide the configuration shown in FIG. 3 and the core is then removed to provide the member shown in FIG. 4.

Although the core is, preferably, a split core, it is to be understood that such a configuration is not essential, as will be understood by those skilled in the art. Although a six-lobed cross-section for the core is preferred, i.e. a core having six crests, it is to be understood that other configurations may also be desired it required. Thus, what is required is that at least one crest is provided, two crests being an ellipse, three crests forming a triangular shape, four crests a square, etc., but it is desired that the form has well rounded edges.

The tubular member 1 is, thus, plastically deformed and, although in the embodiment above-described, the ends of the member 1 are not deformed, the whole of the member 1 may be deformed if desired.

Instead of hydro-deforming the tubular member 1, it may, alternatively, be explosively deformed.

After the step of FIG. 3, the tubular member 1 has a configuration, as shown in FIG. 4, and the member may be heat treated to relieve stresses caused by the forming process.

If the walls of the tubular member 1 are very thick, deforming at ambient temperature may not be possible or may be possible only with very expensive pressure pumping systems. In such instances, it may be necessary to heat the member 1 to reduce the forces required for deformation.

The cylindrical ends of the member are threaded for connection to other tubular members of a drill string. The member 1 may be used as a wash-over pipe for open-hole wash-over operations to avoid differential sticking. Conventional wash-over pipe generally has a diameter which is very close to a well diameter. The contact area between the pipe and the filter cake, one of the factors determining the likelihood of the pipe becoming differentially stuck, is, therefore, drastically increased in comparison to smaller outside diameter tubular elements, As wash-over pipe made in accordance with the present invention considerably reduces the contact area and, therefore, virtually eliminates the risk of differential sticking when washing over a stuck drill string.

To prepare the formed pipe for further manufacturing steps, the wall thickness of the cylindrical end of the pipe (member 1) may be increased by creating external and/or internal upsets. Such a process is usual in drill string manufacturing industry and is followed by heat-treating the pipe. The upset pipe may be threaded and used as special, tool jointless tubular elements such as wash-over pipe.

In an alternative embodiment for forming a drill string member in accordance with this invention, shown in FIGS.

Figure 5:
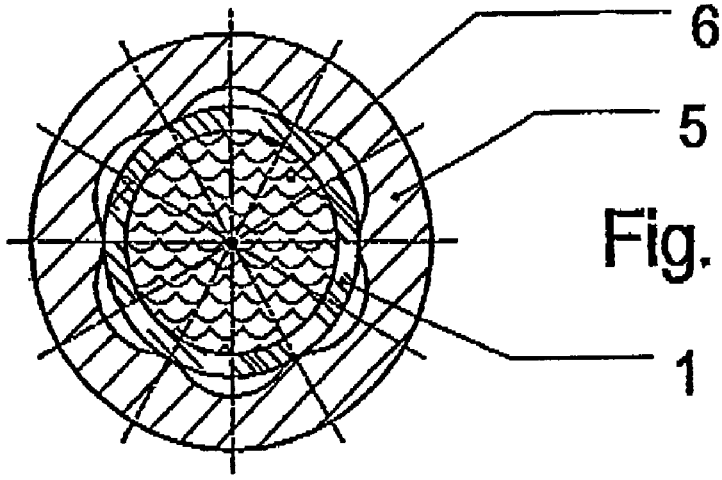
FIG. 5 shows a transverse cross-section through another apparatus for forming a drill string member in accordance with this invention in a first step of formation.
Figure 6:
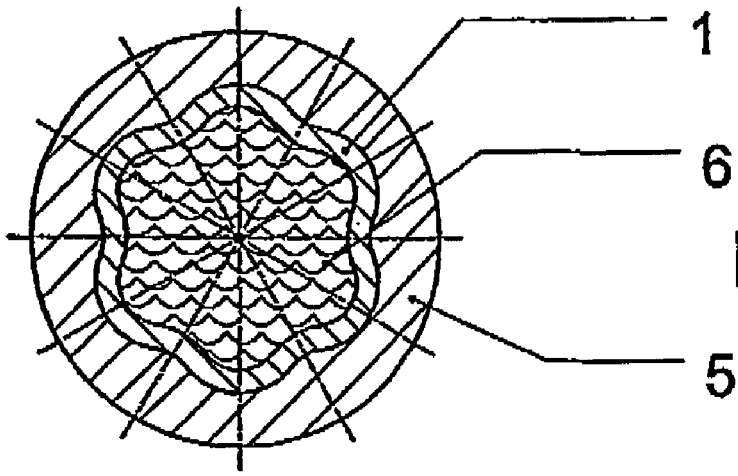
FIG. 6 shows a further step of forming the drill string member using the apparatus of FIG. 5.

5 and 6, the tubular member 1, prior to deformation, is inserted into a thick walled former 5 having an internal surface configured to the shape desired for the member 1. The ends of the member 1 are sealed and liquid 6 is pumped under high pressure into the member 1. It will be noted from FIG. 5 that the outside diameter of the member 1 abuts the crests of the internal shape of the former 5. The liquid is subjected to high pressure causing the member 1 to plastically deform outwardly, as shown in FIG. 6, the seals and former are removed to provide a member, as previously shown in FIG. 4.

In another embodiment of the invention, male and female tool joints are friction welded to opposing ends of the cylindrical portions of the member 1, preferably upset ends of the formed pipe body, thereby creating tubular drill string members such as drill pipe, heavyweight pipe and intermediate weight pipe elements. The tool joints may have the same diameter or, for handling purposes, at least slightly larger diameter than an adjacent cylindrical pipe section. The tool joints may be larger, identical to or smaller in outside diameter than the non-circular portion of the pipe body for drill pipe and heavy wall pipe. For larger outside diameter drill string elements, the outside diameter should, preferably, be of the same diameter as the tool joints or only slightly smaller than the tool joints (external pressure formed elements) or slightly larger than the tool joints (internal pressure formed elements) to reduce bending stresses and wear in the tool joint area.

In general, the diameter of a circle inscribed in the cross-section of the non-circular section of the member 1 should be not smaller than the inside diameter of the tool joints. If the manufacturing process or the desired external shape of the pipe should result in a smaller diameter of the inscribed circle, metal may need to be removed from the inside of the pipe by boring or on a lathe. A member so modified is intended to be within the scope of the present invention.

In some instances it may be necessary to cover the crests on some portions of the non-circular portion of pipe with a protective layer of hard metal for increased wear resistance. Conversely, to obtain an evenly thick layer of hard metal, the outside diameter of the member may be slightly reduced on a lathe prior to applying the hard metal layer. A member treated in such a manner is also within the scope of the present invention.

Figure 7:
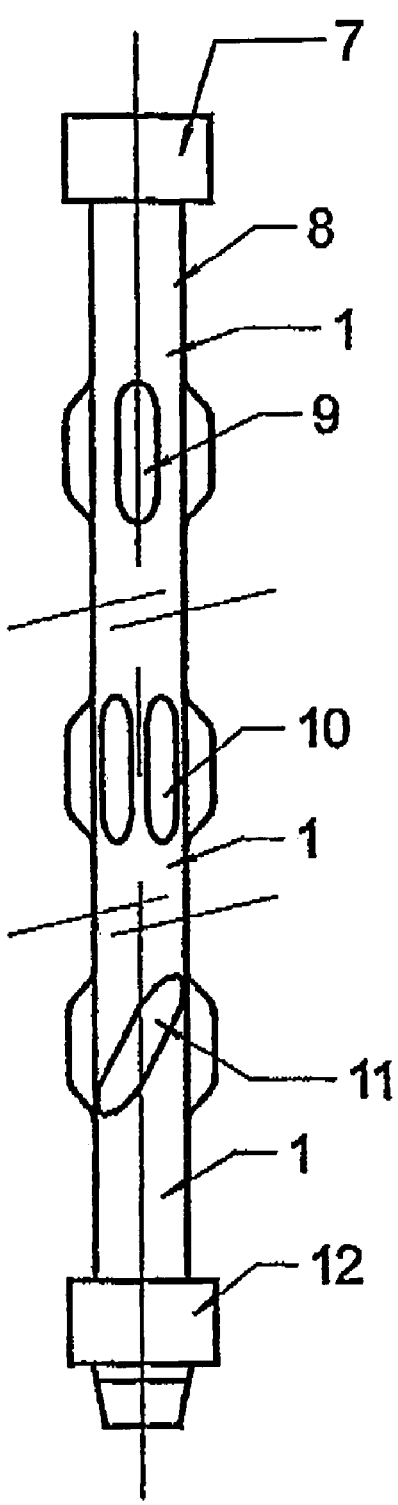
FIG. 7 shows a side view of plural drill string members each formed in accordance with this invention mounted in situ in a drill string.

Referring to FIG. 7, plural members 1, each formed in accordance with this invention, are serially connected in a drill string. The uppermost member 1 has a circular cross-section portion 8 having the same configuration to the initial cylindrical tubular member before deformation and the deformed member has four lobes 9 each extending longitudinally of the member 1. A top, remote end of the member 1 has a female top connection joint 7 secured to the member 1 by, for example, friction welding. The intermediate member 1 has a six-lobed configuration, each of which extend longitudinally of the member 1. A bottom member 1 has four lobes 11 which are helically formed about the member 1 and a male joint 12 is connected to one end of the bottom member 1 by, for example, friction welding. Each of the members 1 are interconnected by mating threaded tool joints (not shown). Each of the lobe formations of the members 1 are formed in a manner described above.

Figure 8:
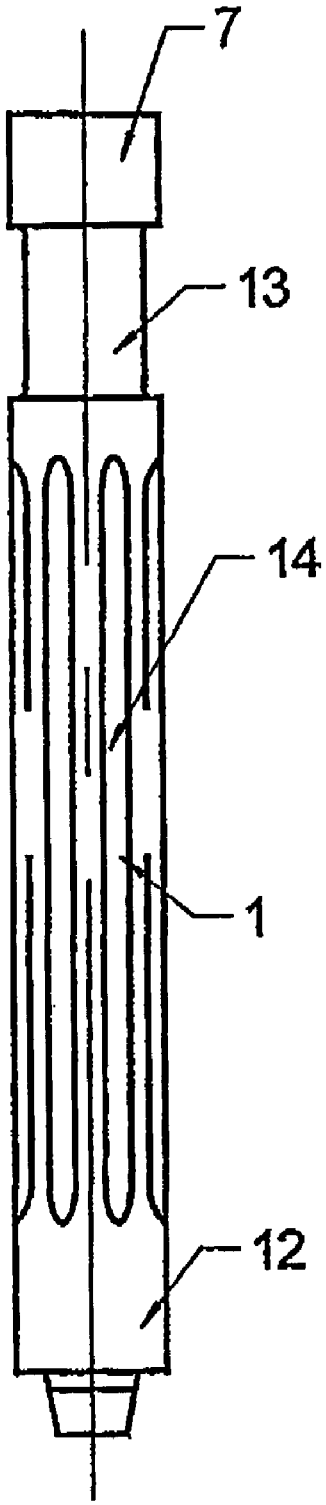
FIG. 8 shows a side view of a further drill string member formed in accordance with this invention.

In FIG. 8, a tubular member 1 has a circular cross-section portion 13 forming an elevator and slip recess. The member 1 has six lobes 14 which are indented from the initially provided cylindrical member and are formed in accordance with this invention.

Figure 9:
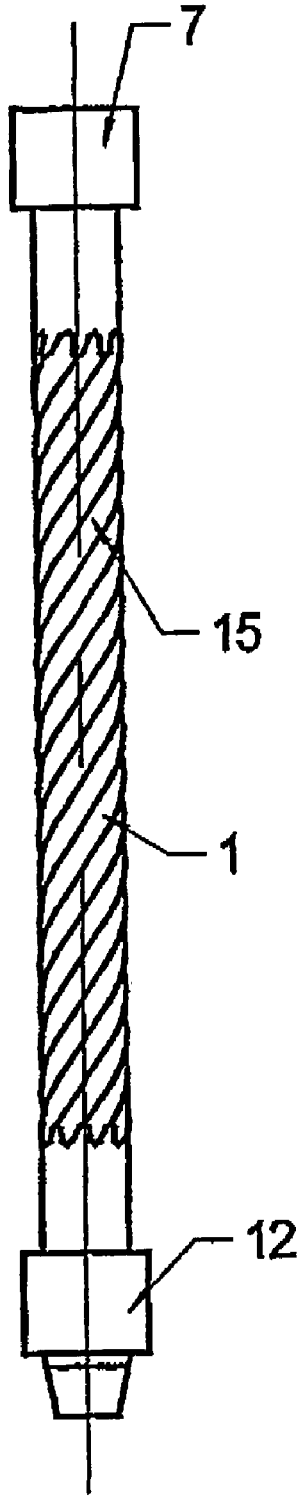
FIG. 9 shows another drill string member formed in accordance with this invention.

The embodiment shown in FIG. 9 has a member 1 with a helical formation of six lobes 15 which are indented from the initially provided circular member and are formed in accordance with this invention.

Thus, the present invention provides a less expensive manner of forming a drill string member which is useful for preventing differential sticking.

What is claimed is:

1. A drill string member to at least alleviate one of differential sticking and to facilitate the transport of cuttings in at least one of a high angle and a horizontal well bore including a single tubular member formed to have a portion with a non-circular internal and external cross section and opposing end portions of said non-circular portion having a substantially circular cross section, wherein said non-circular portion has undulating inner and outer surfaces with crests and troughs extending across a longitudinal axis of said single tubular member and a substantially constant wall thickness about the circumference thereof is provided, wherein tool joints are secured by friction welding to said circular end portions, and further wherein said tubular member has a circular cross-sectioned portion provided between said non-circular portion and an upper tool joint to form an elevator and slip recess.

2. A drill string member as claimed in claim 1, wherein said crests and troughs form a spiral groove in a wall of said single tubular member.

3. A drill string member as claimed in claim 2, wherein said spiral groove is a right hand spiral.

4. A drill string member as claimed in claim 2, wherein said crests and troughs extend along a longitudinal axis of said single tubular member.

5. A drill string member as claimed in claim 1, wherein said single tubular member has two or more crests.

6. A drill string member as claimed in claim 1, wherein said single tubular member has three to eight crests.

7. A drill string member as claimed in claim 1, wherein said single tubular member has six crests in a plane transverse to a longitudinal axis through said non-circular portion.

8. A drill string member as claimed in claim 1, wherein male and female tool joints are secured to the circular end portions at respective opposing ends of said member and plural said single tubular members are provided in a drill string, each interconnected by inter-engagement of said male and female tool joints.

9. A drill string member as claimed in claim 1, wherein said drill string member is used as one of a drill pipe, an intermediate weight drill pipe, a heavyweight drill pipe, a drill collar, and a wash-over pipe.

10. A drill string member as claimed in claim 1, wherein the tool joints have an outside diameter which is substantially the same as the outside diameter of the non-circular portion.

11. A drill string member as claimed in claim 1, wherein the diameter of a circle inscribed in the cross-section of the non-circular portion is not smaller than the inside diameter of the tool joints.

12. A drill string member as claimed in claim 1, wherein at least some of the outer surfaces of the crests are provided with a protective layer of hard metal to increase wear resistance.

* * * * *